US012779289B1

(12) United States Patent
Marris et al.

(10) Patent No.: US 12,779,289 B1
(45) Date of Patent: Nov. 3, 2026

(54) INTELLIGENT SPORTING OBJECT AND SYSTEMS AND METHODS FOR MANUFACTURING OF INTELLIGENT SPORTING OBJECT

(71) Applicant: Chip'D Inc., Murrieta, CA (US)

(72) Inventors: Joshua L. Marris, Winchester, CA (US); Anil K. Agarwal, Rancho Mission Viejo, CA (US); David Hester, San Diego, CA (US); Brandon Pollack, Lake Forest, CA (US)

(73) Assignee: Chip'D Inc., Murrieta, CA (US)

( * ) Notice: Subject to any disclaimer, the term of this patent is extended or adjusted under 35 U.S.C. 154(b) by 0 days.

(21) Appl. No.: 19/361,257

(22) Filed: Oct. 17, 2025

(51) Int. Cl.
*A63B 43/00* (2006.01)
*A63B 24/00* (2006.01)

(52) U.S. Cl.
CPC ..... *A63B 43/004* (2013.01); *A63B 24/0021* (2013.01); *A63B 2024/0028* (2013.01); *A63B 2225/50* (2013.01)

(58) Field of Classification Search
CPC ..... A63B 43/004; A63B 24/0021; A63B 2024/0028; A63B 2225/50
See application file for complete search history.

(56) References Cited

U.S. PATENT DOCUMENTS

| | | | |
|---|---|---|---|
| 4,934,060 | A | 6/1990 | Evans |
| 6,157,898 | A | 12/2000 | Marinelli |
| 7,691,009 | B2 | 4/2010 | Savarese et al. |
| 9,592,424 | B2 | 3/2017 | Savarese et al. |
| 10,213,646 | B2 | 2/2019 | Sandel et al. |
| 11,344,785 | B1 | 5/2022 | Raposo et al. |
| 12,138,509 | B2 | 11/2024 | Marris et al. |
| 12,390,690 | B2 | 8/2025 | Marris et al. |
| 2002/0091019 | A1 | 7/2002 | Bays et al. |
| 2005/0085316 | A1 | 4/2005 | Barr |
| 2005/0259002 | A1 | 11/2005 | Erario et al. |
| 2006/0122007 | A1 | 6/2006 | Savarese et al. |
| 2007/0021226 | A1 | 1/2007 | Tyroler |

(Continued)

FOREIGN PATENT DOCUMENTS

| | | |
|---|---|---|
| CA | 2883098 | 6/2012 |
| CA | 2865338 | 7/2013 |

(Continued)

OTHER PUBLICATIONS

CN 210409436 U Translation (Year: 2020).*

(Continued)

*Primary Examiner* — Jeffrey S Vanderveen
(74) *Attorney, Agent, or Firm* — McAndrews Held & Malloy, Ltd.

(57) ABSTRACT

Advanced manufacturing and design of intelligent sporting objects are provided. A sports object includes a core assembly arranged within a shell and having multiple components to receive and transmit signals corresponding to movement of the sports object, as well as to support operational tracking of the sports object. The shell may be comprised of two hemisphere portions configured to hold the multiple components, or may comprise a hollowed portion configured to hold an energy storage device. The shell may be further configured to be encapsulated by an exterior material, which may include, for example, dimples.

21 Claims, 24 Drawing Sheets

(56) References Cited

U.S. PATENT DOCUMENTS

| | | | | |
|---|---|---|---|---|
| 2010/0184563 | A1 | 7/2010 | Molyneux et al. | |
| 2011/0230274 | A1 | 9/2011 | Lafortune et al. | |
| 2015/0009629 | A1 | 1/2015 | Moon | |
| 2015/0105173 | A1* | 4/2015 | Thurman | A63B 71/06 473/199 |
| 2016/0001136 | A1* | 1/2016 | King | A63B 41/00 320/108 |
| 2016/0138824 | A1 | 5/2016 | Patel et al. | |
| 2016/0233795 | A1* | 8/2016 | Savelli | A43B 3/35 |
| 2018/0200576 | A1 | 7/2018 | Marris et al. | |
| 2018/0214758 | A1 | 8/2018 | Mosher et al. | |
| 2018/0236303 | A1 | 8/2018 | Mathar | |
| 2019/0344144 | A1 | 11/2019 | San Juan | |
| 2020/0324171 | A1 | 10/2020 | Semsak et al. | |
| 2022/0357440 | A1 | 11/2022 | Hugmark et al. | |
| 2023/0012509 | A1 | 1/2023 | Lee et al. | |
| 2023/0033421 | A1 | 2/2023 | Goodchild | |
| 2024/0033582 | A1* | 2/2024 | Engler | A63B 37/0098 |
| 2024/0226657 | A9 | 7/2024 | Marris et al. | |
| 2025/0065190 | A1 | 2/2025 | Marris et al. | |
| 2026/0027416 | A1 | 1/2026 | Marris et al. | |

FOREIGN PATENT DOCUMENTS

| | | | | |
|---|---|---|---|---|
| CN | 210409436 U | * | 4/2020 | |
| JP | 2019511194 A | * | 4/2019 | A63B 37/007 |
| KR | 20120076418 | | 7/2012 | |

OTHER PUBLICATIONS

JP 201911194 A Translation (Year: 2019).*
Int'l Search and Written Opinion Appln No. PCT/US2018/012690 mailed Mar. 7, 2018.
Final office action, U.S. Appl. No. 19/296,102 dated Mar. 24, 2026.

* cited by examiner

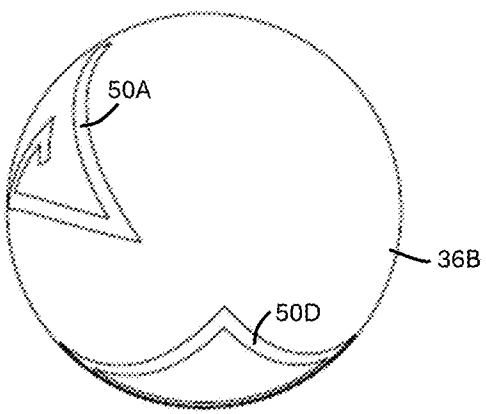
FIG. 8D
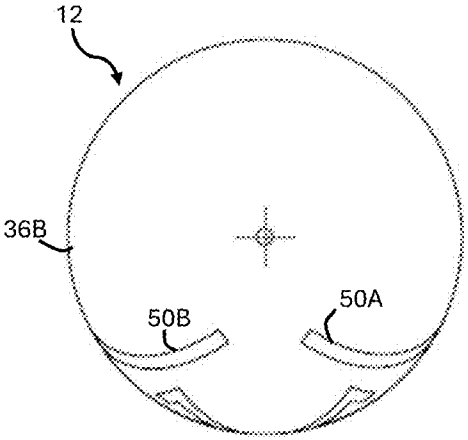
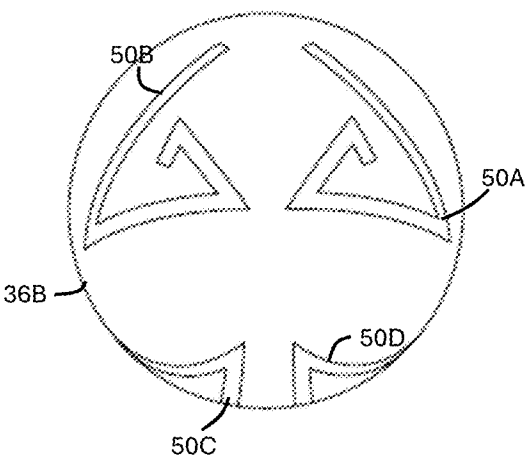

INTELLIGENT SPORTING OBJECT AND SYSTEMS AND METHODS FOR MANUFACTURING OF INTELLIGENT SPORTING OBJECT

BACKGROUND

Manufacturing and design of intelligent sporting objects—i.e., objects that are used in various sports-related activities, such as golf balls, soccer balls, basketballs, baseballs, footballs, tennis balls, ice hockey pucks, lacrosse ball, cricket ball, flying discs, etc.—can be difficult to implement, expensive, and have limited application in many sporting environments. Internal components of an intelligent sporting object may be difficult or expensive to replace and manufacturing costs of intelligent sporting objects may be high. Thus, there remains a need for a system that provides components capable of simplified replacement or repair, and which reduces manufacturing costs of intelligent sporting objects.

Aspects of the present disclosure fulfill these needs and provide further related advantages as described in the following summary.

SUMMARY

Aspects of the present disclosure teach certain benefits in construction and use which give rise to the exemplary advantages described below.

Disclosed examples generally relate to manufacturing and design of intelligent sporting objects, and, more particularly, to a system for creating intelligent sporting objects that includes a core assembly in a shell and associated methods of manufacture and design of such a system.

The disclosed systems and methods provide a compact, multi-purpose system, enclosed in a core assembly that is advantageously incorporated into a sports object without impacting performance of the object. The system includes hemispheres configured to contain various electronic components or a hollowed portion of a shell configured to removably receive an energy storage device.

Certain embodiments of the technology may include an intelligent sports object including a core assembly removably placed within a shell, wherein the shell includes a first hemisphere containing a hollowed portion and a second hemisphere containing a hollowed portion. The first hemisphere is configured to interface with the second hemisphere, the first and second hemispheres forming a complete sphere. The core assembly may include a core assembly shell, an energy storage device arranged within the shell, and one or more electronic components arranged within and in direct contact with the core assembly shell, such that an end surface and a lateral surface of the components are in direct contact with two or more internal surfaces of the core assembly shell. The core assembly may be configured to fit within the hollowed portions of the complete sphere when the first and second hemisphere are interfaced.

The core assembly shell may have an external geometry configured to mate with an internal geometry of the hollowed portions. The external and internal geometries may comprise one or more grooves configured to secure the core assembly within the shell. The external and internal geometries may comprise one or more detents configured to secure the core assembly within the shell. The external and internal geometries may be configured to form a polygonal, cross-section in a variety of shapes, wherein the shapes include one or more of a triangle, a square, a hexagon, or an octagon. The energy storage device may be removably placed within the core assembly. The energy storage device may be configured to be replaced with another energy storage device. The core assembly may be configured to be replaced with another core assembly. The first and second hemispheres may be configured to be separable. The first and second hemispheres may be created using a mold configured to create a hemisphere. The electronic components may comprise a multi-layer printed circuit board (PCB) comprised of one or more contacts and a plurality of sections, the PCB configured to at least partially envelope the energy storage device, and one or more antennas arranged within the shell, wherein the one or more contacts of the PCB are configured to connect to the one or more antennas.

Certain embodiments of the present technology may include an intelligent sports object comprising a core assembly enclosed within a shell, wherein the shell has an internal cavity and wherein the internal cavity is configured to receive the core assembly. The core assembly may comprise an energy storage device arranged within the shell and one or more electronic components arranged within the shell, and a plug for the internal cavity of the shell, wherein the plug is configured to seamlessly interface with the shell.

The one or more electronic components may be fixed within the shell, and the energy storage device may be removably placed within the cavity. A resin may surround the electronic components. The cavity may be configured to form a polygonal, cross-section in a variety of shapes, wherein the shapes include one or more of a triangle, a square, a hexagon, or an octagon. The core assembly may further comprises a port, wherein the port is configured to receive a charging cable configured to charge the energy storage device. The plug may be fixed to the core assembly. The energy storage device may be threadably engaged with the core assembly. The core assembly may be threadably engaged with the cavity. The electronic components may comprise a multi-layer printed circuit board (PCB) comprised of one or more contacts and a plurality of sections, the PCB configured to at least partially interface with the energy storage device and one or more antennas arranged within the shell, wherein the one or more contacts of the PCB are configured to connect to the one or more antennas.

Certain embodiments of the present technology include a process of manufacturing an intelligent sporting object comprising the steps of creating a first and second hemisphere, the first and second hemispheres each containing a hollowed portion, creating a core assembly, the core assembly comprising one or more electronic components and an energy storage device, placing the core assembly within the hollowed portion of either the first or second hemisphere, placing the remaining hemisphere on the hemisphere containing the core assembly, sealing the completed sphere structure, and encapsulating the sphere with an external material.

Other features and advantages of aspects of the present disclosure will become apparent from the following more detailed description, taken in conjunction with the accompanying drawings, which illustrate, by way of example, the principles of aspects of the disclosure.

BRIEF DESCRIPTION OF THE DRAWINGS

The accompanying drawings illustrate aspects of the present disclosure.

FIGS. 8A, 8B, 8C, and 8D illustrate a view of one or more antennas on a core of an intelligent sports object, in accordance with another aspect of this disclosure.

Figure 1A:
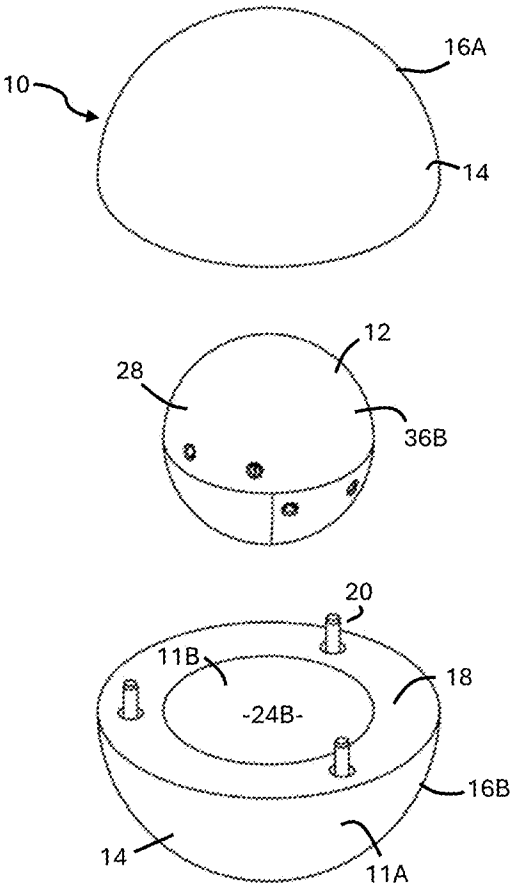
FIGS. 1A, 1B, and 1C illustrate an exemplary system for manufacturing an intelligent sports object, in accordance with aspects of this disclosure.

The above-described drawing figures illustrate aspects of the disclosed subject matter in at least one of the following examples, which are further defined in detail in the following description. The figures are not necessarily to scale. Features, elements, and aspects of the system that are referenced by the same numerals in different figures represent the same, equivalent, or similar features, elements, or aspects, in accordance with one or more examples.

DETAILED DESCRIPTION

Disclosed are systems and methods for manufacturing an intelligent sports object. In some examples, a sports object includes a core assembly arranged within a shell and having multiple components to receive and transmit signals corresponding to movement of the sports object, as well as to support operational tracking of the sports object.

In disclosed examples, the core assembly is removably placed in a shell, wherein the shell comprises a first and second hemisphere which are configured to interface and form a completed sphere. The two hemisphere portions include hollowed portions, configured to house the core assembly.

In some examples, electronic components arranged within the core assembly may come into direct contact with the shell.

In disclosed examples, the core assembly includes a multi-layer printed circuit board (PCB) comprised of a plurality of sections. The PCB is configured to at least partially envelope the energy storage device at a geometric center of the assembly.

In some examples, the PCB is connected to one or more antennas (e.g., via one or more contacts), which may be arranged on one or more sections of the PCB, arranged on a surface of the shell, and/or in a volume within the shell.

In some examples, a mold or support structure is arranged within the shell, and configured to hold, mount, and/or otherwise support the PCB and/or the energy storage device. Each hemisphere may contain a portion of the mold or support structure. The shell can be configured to enclose the components of the core assembly within the volume.

Through the combined arrangement of the components, along with selection of proper materials, the core assembly of the sports object remains functional throughout the manufacturing process, as well as during a sporting activity. The disclosed design is operable to withstand a range of pressures and impact forces (e.g., approximately 200-800 pounds-per-square-inch (PSI)), impact force of approximately 2000 lbs, in addition to elevated temperatures (e.g., approximately 150 to 170 degrees Celsius for 15 seconds or more).

The combination of componentry and materials advantageously yields favorable operational aspects due to the electrical and mechanical properties thereof. The electrical properties, centered around the PCB, include the ability to identify and track the location of the object (e.g., through a global navigation satellite system (GNSS)), motion (e.g., via a gyroscope, accelerometer, magnetometer, etc.), relative position, proximity or movement (e.g., via a gyroscope, magnetometer, ultra-wide band (UWB), etc.), as well as enable wireless charging of the device (e.g., via high frequency signals, including near-field communications (NFC)), enhanced transmission/receiving signal quality (e.g., via antenna design and matching), data transmission (e.g., low energy Bluetooth (BT), NB IOT, Wi-Fi, long range (LORA) radio communication, cellular), geo-fencing (e.g., BT beacons, UWB tags, LORA, etc.), power management (e.g., motion detection states, wake routines, etc.), and/or extended range BT, LORA, or cellular) (e.g., via long range data communication protocols), as a list of non-limiting example capabilities.

The mechanical properties, comprising and/or supporting the core assembly, include the ability to modify and set the center of gravity and/or center of mass (e.g., via PCB size, shape, flexibility; energy storage device size, shape, and placement; etc.), weight (e.g., material selection, balancing, etc.), thermal, impact and shock tolerance (e.g., by selection of core assembly size within deformation limits upon high impact), and antenna construction and arrangement (e.g., of the multiple antennas for various signal transmission/reception events, such as BT, Wi-Fi, GPS L1/L5, wireless charging, etc.), as a list of non-limiting examples.

Advantageously, the completed sports object allows for multiple user application and communication applications, including data collection, data analytics, user identification, user data repository, and data sharing, as a list of non-limiting examples.

In disclosed examples, a system for tracking a sports object includes a sports object having a core assembly enclosed within a shell. The core assembly includes an energy storage device arranged within the shell; and a multi-layer printed circuit board (PCB) comprised of one or more contacts and a plurality of sections. The PCB is configured to at least partially envelope the energy storage device, and one or more antennas are arranged within the shell, wherein the one or more contacts of the PCB are configured to connect to the one or more antennas. The core assembly may include a distinct core assembly shell.

In some examples, the shell comprises a mount to secure the PCB and the energy storage device and maintain the balance of the components in terms of the center of mass of the shell.

In some examples, the system includes a mold configured to house the energy storage device in a center of the mold, and to support the plurality of sections of the PCB as the PCB envelopes the energy storage device.

In some examples, the mold is dimensioned to fit within the mount.

In some examples, the energy storage device has a cylindrical, spherical, or prismatic shape.

In some examples, the energy storage device is a battery. In such examples, the battery may be rechargeable or disposable. In some examples further described herein, the sporting object is configured such that the energy storage device may be replaced when it runs out of power.

In some examples, the core assembly further comprises a resin surrounding the PCB and the various electronic components and the energy storage device.

In some examples, the plurality of antennas includes one or more of an ultra-wide band antenna, a blue tooth antenna, or a global positioning system antenna or a NFC antenna.

In some examples, one or more of the plurality of antennas are printed on one or more surfaces of the object.

In some examples, one or more of the plurality of antennas are printed, mounted or embedded on one or more surfaces of the shell.

In some examples, the one or more of the plurality of antennas are printed in a spiral pattern.

In some examples, the one or more of the plurality of antennas are printed in non-spiral patterns on an external surface of the core, including geometric patterns, random patterns, pseudo-geometric patterns (e.g., patterns incorporating one or more geometric patterns and one or more random patterns), uniform patterns, non-uniform patterns.

In some examples, the one or more of the plurality of antennas are printed, mounted or embedded on one or more sections of the PCB.

In some examples, the energy storage device is a rechargeable energy storage device, the system further comprising an induction coil configured to receive a wireless signal to generate a current to charge the rechargeable energy storage device.

In some examples, the induction coil is arranged on a surface of the shell.

In some examples, the induction coil is printed in a spiral or rectangular shape on one or more surfaces of the shell.

In some disclosed examples, a core assembly for a sports object includes an energy storage device; a printed circuit board (PCB) comprised of one or more contacts and a plurality of sections, the PCB configured to at least partially envelope the energy storage device; a shell comprising a mount to secure the PCB and the energy storage device; and one or more antennas arranged within the shell, wherein the one or more contacts of the PCB are configured to connect to the one or more antennas.

In some examples, the one or more contacts extend from the plurality of sections of the PCB, the plurality of sections configured to wrap around a length of the energy storage device, and the one or more contacts are configured to cap an end of the energy storage device.

In some examples, the plurality of sections comprises six sections, the PCB configured to form a hexagonal cross-section when enveloped around the mount and the energy storage device.

In some examples, the assembly includes a mold configured to house the energy storage device in a center of the mold, and to support the plurality of sections of the PCB as the PCB envelopes the energy storage device.

In some examples, the shell has a spherical exterior shape.

In some examples, the assembly includes one or more weights arranged within the shell to balance mass distribution of the sports object.

In some examples, the sports object is one of a golf ball, a lacrosse ball, a baseball, a softball, a soccer ball, a basketball, an ice hockey puck, cricket ball, a bowling ball, a rugby ball, or an American football, a cornhole beanbag, or a surf board.

Figure 1B:
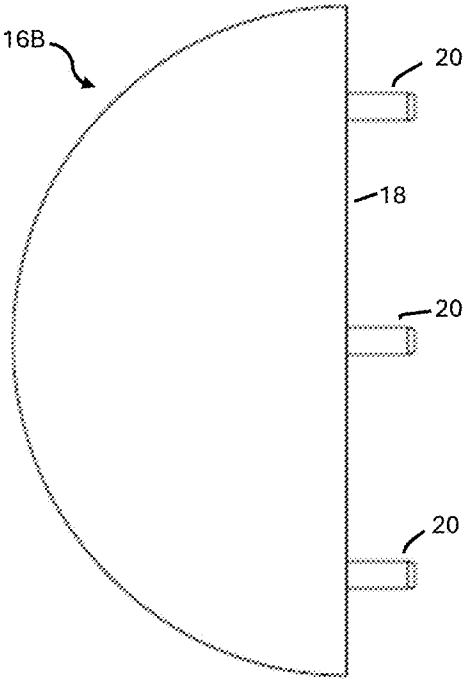
Figure 1C:
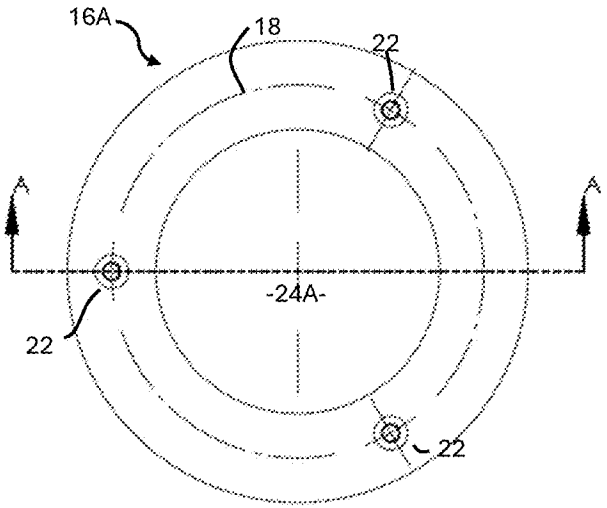

Turning now to the figures, FIGS. 1A, 1B, and 1C illustrate an exemplary system 10 for manufacturing an intelligent sports object. The sports object may be a ball, but is not so limited. As shown in FIG. 1A, the system 10 includes a core assembly 12 enclosed within a shell 14 having first and second hemispheres 16A and 16B, respectively. The core assembly may be encased in its own core assembly shell 28. The shell 14 can be encapsulated within a material comprising the exterior of the system 10. The hemispheres 16A and 16B each contain a hollowed portion 24A and 24B configured to mate with or otherwise securely hold the core assembly 12. The hemispheres 16A and 16B of the shell may further comprise external 11A and internal 11B surfaces by nature of having the hollowed portions 24A and 24B.

In some embodiments, the hemispheres 16A and 16B mate at an interface 18 operable to hold the hemispheres 16A and 16B together. This interface 18 can be snap fit, a threaded feature, an adhesive/epoxy bonded joint, and thermal welded (such as laser, ultrasonic, or hot plate welding), as a list of non-limiting examples.

In some examples, the interface 18 may include holes 22 (FIG. 1C) configured to mate with posts 20 in the second hemisphere 16B. The holes 22 in the first hemisphere 16A allow the first and second hemispheres to form a sealable sphere.

The hemispheres 16A and 16B may be comprised of a sturdy flexible material, for example, polybutadiene rubber. Material used to make the hemispheres may be a material which can be formed via molding, in accordance with an embodiment described herein.

The hemispheres 16A and 16B may be secured together using adhesive material. The adhesive material may, for example, be a urethan adhesive, such as 3M DP601. In some examples, the adhesive material may be configured such that its bond can be broken at a later time, allowing access to the core 12. The hemispheres 16A and 16B can be snap fit, a threaded feature, an adhesive/epoxy bonded joint, and thermal welded (such as laser, ultrasonic, or hot plate welding), as a list of non-limiting examples.

Figure 4:
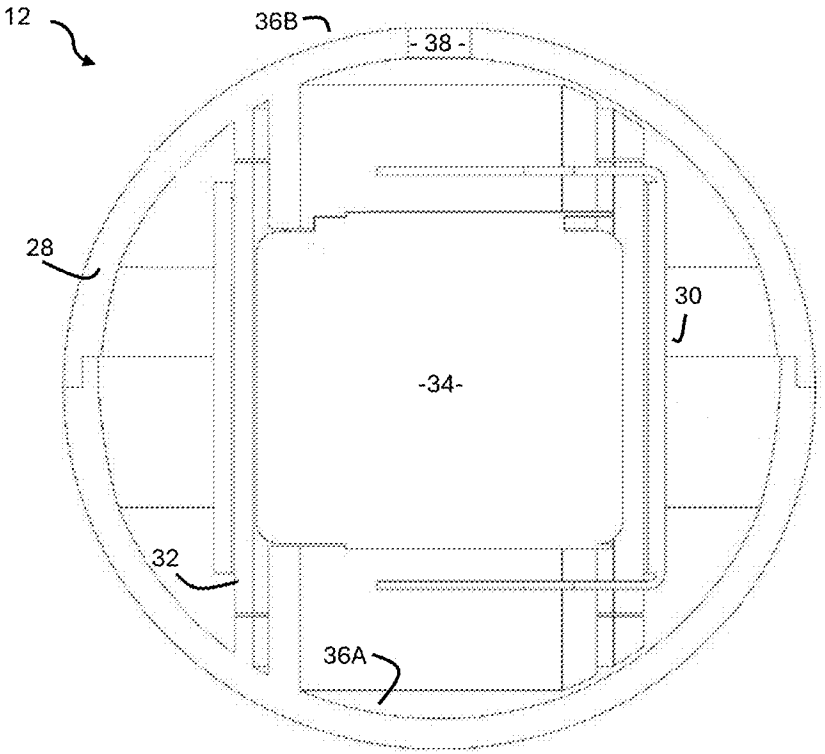
FIG. 4 illustrates an exemplary core assembly of an intelligent sports object, in accordance with aspects of this disclosure.
Figure 8A:
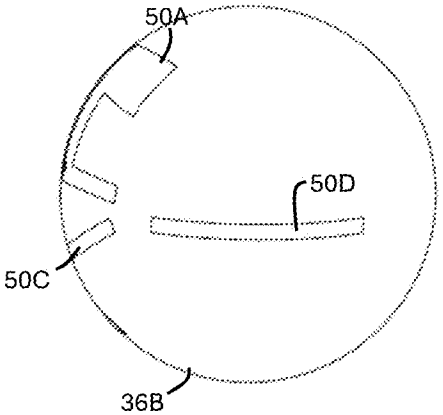
Figure 8A:
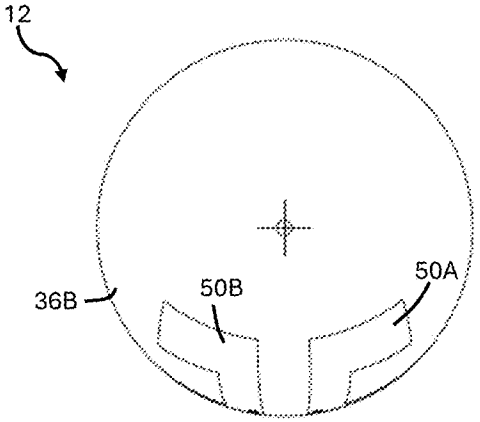
Figure 8A:
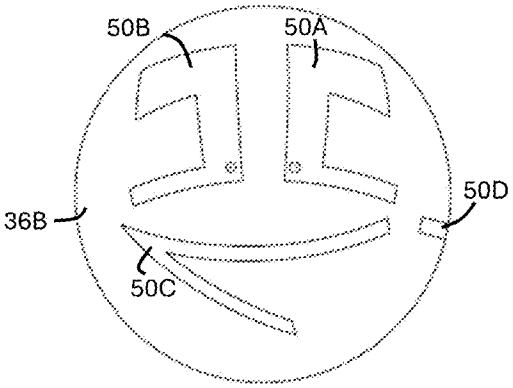
Figure 8B:
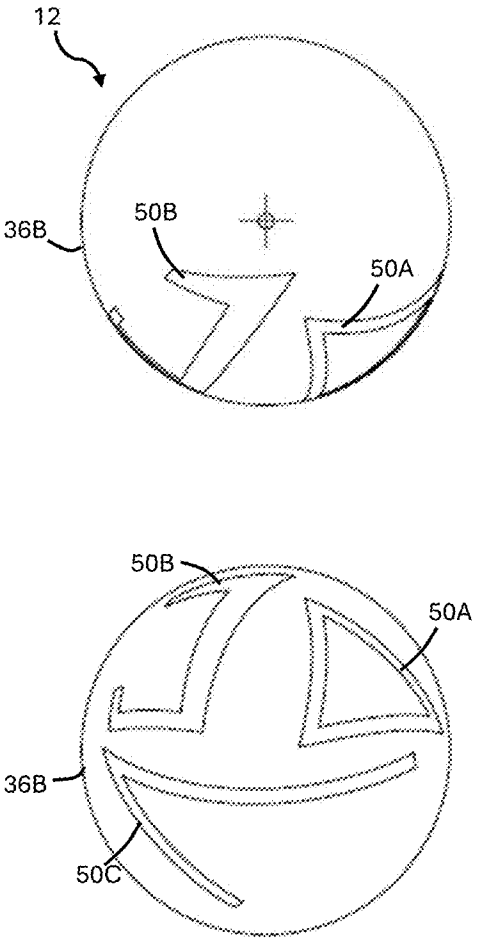
Figure 8B:
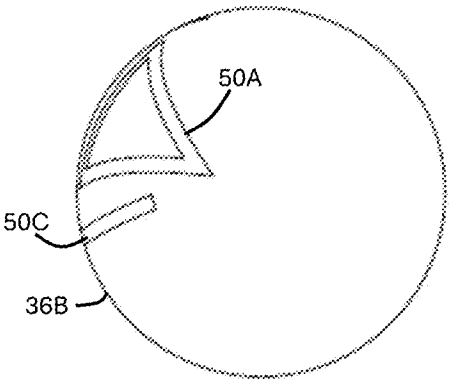
Figure 8C:
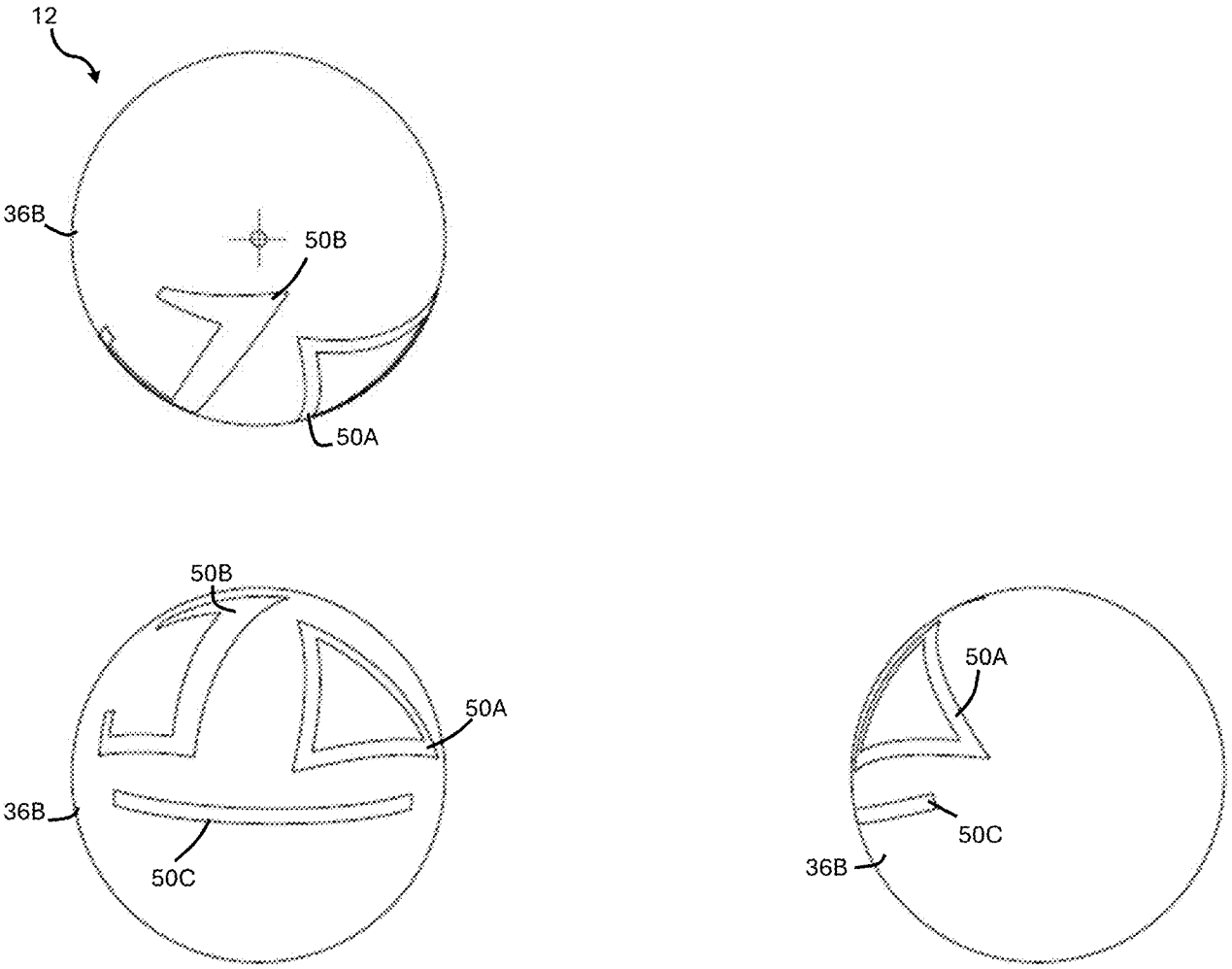

In some examples, and with reference to FIG. 4, the core assembly 12 includes an energy storage device 34 arranged within the shell 14, and a printed circuit board (PCB) 30. In some examples, the PCB 30 can include a plurality of sections (e.g., 40A and 40B), which can be defined as a multi-layer, which may be flexible, rigid or a combination thereof. One or more contacts can extend from one or more sections 40A and 40B, such as to make electrical contact with the energy storage device 34 and/or an antenna (e.g., antennas 50*a*, 50*b*, or 50*c* in FIG. 8A). In some examples, the PCB 30 is configured to at least partially envelop the energy storage device 34.

With the components of the core assembly 12 installed within the shell 14, a volume may surround the components.

Based on a size and/or resulting geometry of the components, the volume may exist on one or more sides, such as along the sides of the folded PCB 30 enveloping the energy storage device 34, and/or at top/bottom ends thereof.

In some examples, the core assembly 12 may further comprise an external geometry configured to mate with an internal geometry of the hemispheres 16A and 16B. The external or internal geometries may comprise, for example, one or more grooves, detents, or threadings. The internal and external geometries may be further configured to form a polygonal cross-section in a variety of shapes, including, for example, a triangle, square, hexagon, or an octagon. In such examples, the core assembly 12 is secured within the shell 14 such that it will not move when the sports object is subject to sudden changes of acceleration.

In other examples, the electronic components of the core assembly 12 may comprise geometries configured to make direct contact with the hollowed portions 24A and 24B of the hemispheres 16A and 16B. The geometries of the core assembly may be one or more of detents, grooves, or threadings, as a list of non-limiting examples.

Although some examples of the disclosed sports object are illustrated as a golf ball, the core assembly and tracking system can be used as a core for a variety of sporting objects, such as baseballs, softballs, cricket balls, lacrosse balls, field hockey balls, and ice hockey pucks, as a list of non-limiting examples.

Figure 2A:
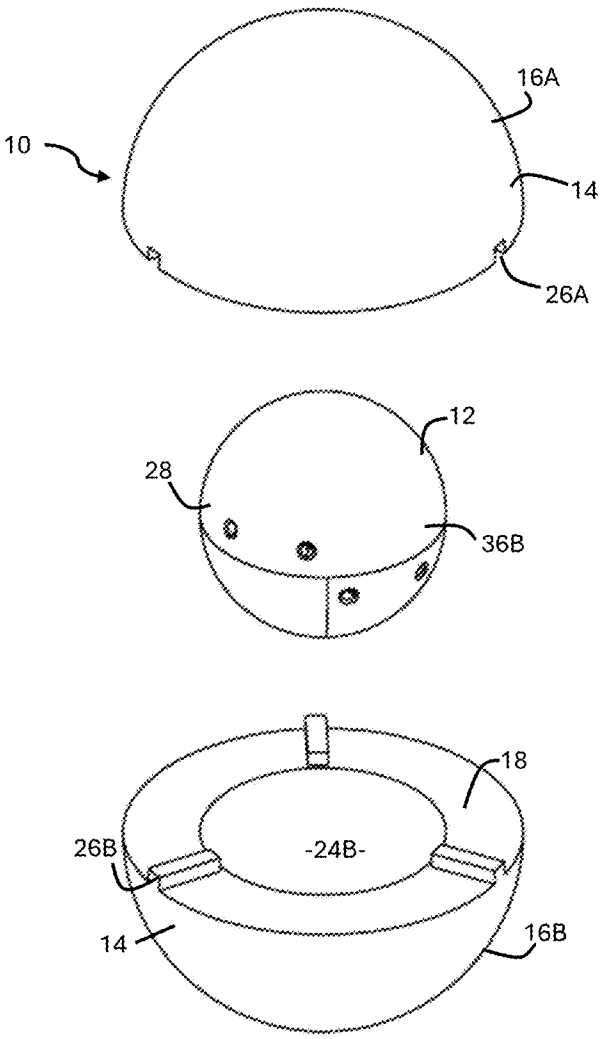
FIGS. 2A, 2B, and 2C illustrate an exploded view of an exemplary system for manufacturing an intelligent sports object, in accordance with aspects of this disclosure.
Figure 2B:
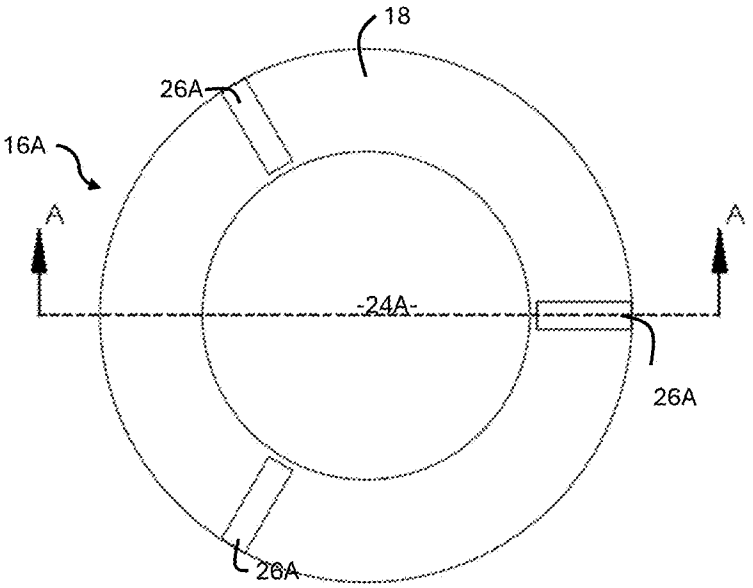
Figure 2C:
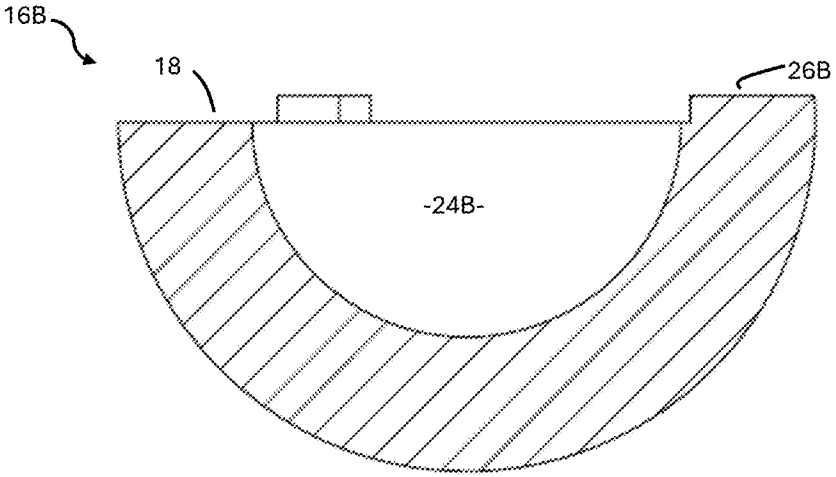

FIGS. 2A, 2B, and 2C illustrate exemplary system 10 for manufacturing an intelligent sports object. FIG. 2A illustrates an embodiment wherein the first and second hemispheres 16A and 16B are configured to mate via one or more geometries 26A and 26B (e.g., detents or grooves).

As shown in FIGS. 2A, 2B, and 2C, the one or more geometries 26A and 26B may be in the surface of one of the hemispheres (16A or 16B), with the other hemisphere configured to mate with the geometries 26A and 26B. The structure shown in FIGS. 2A, 2B, and 2C may be created via a molding process, in accordance with a disclosure herein. A mold may be created for each hemisphere, allowing the hemispheres to be created with the geometries 26A and 26B to efficiently manufacture intelligent sporting objects.

Figure 3A:
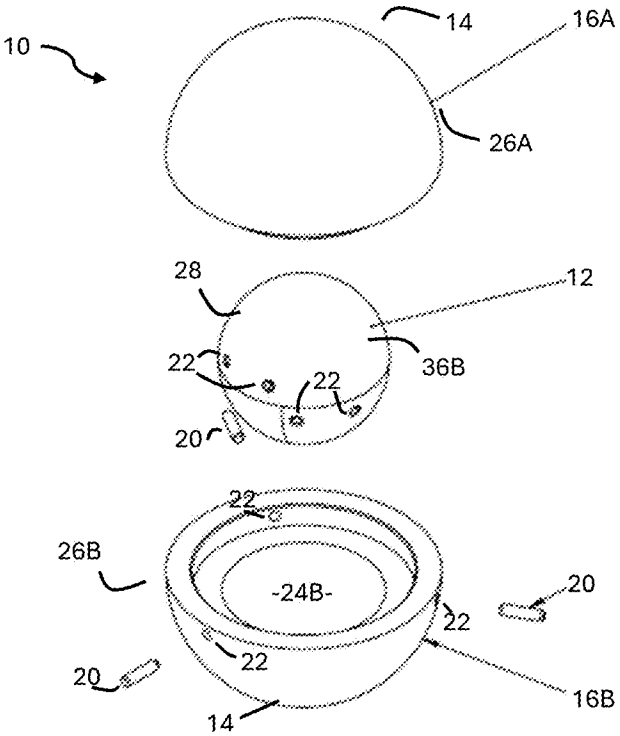
FIGS. 3A, 3B, and 3C illustrate an exploded view of an exemplary system for manufacturing an intelligent sports object, in accordance with aspects of this disclosure.
Figure 3B:
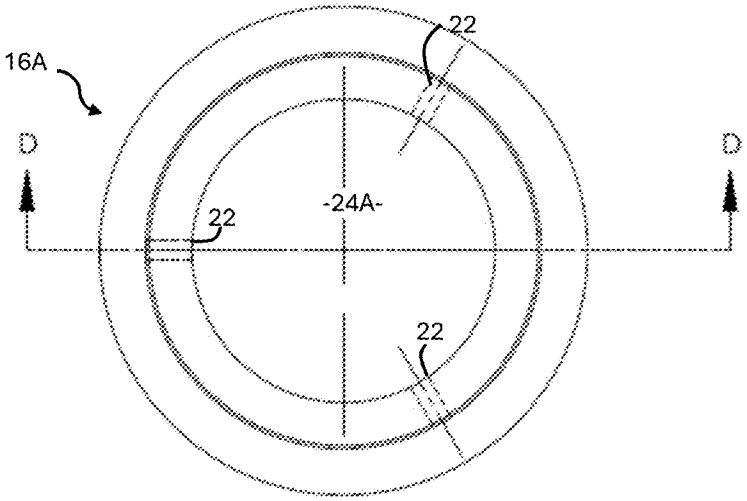
Figure 3C:
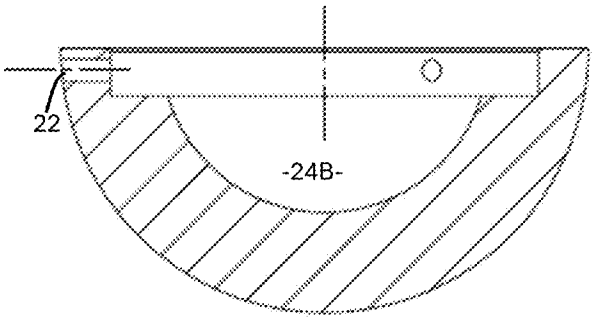

FIGS. 3A, 3B, and 3C illustrate exemplary system 10 for manufacturing an intelligent sports object. FIG. 3A illustrates an embodiment wherein the first and second hemispheres 16A and 16B are configured to mate via one or more posts 20. As shown in FIG. 3A, the posts 20 are configured to mate with one or more holes 22 in the core and/or the shell. The holes 22 may comprise a variety of shapes, or may include threading configured to mate with the posts 20. In some examples, the posts 20 can extend through the walls of the hemispheres and into holes 22 on a surface of the core assembly 12, fixing an orientation or position of the core assembly within the sphere.

The shell 14 can be formed of a rigid or semi-rigid material, such as Nylon, Polycarbonate (PC), Acrylonitrile butadiene styrene (ABS), Polystyrene (PS), Polymethyl methacrylate (PMMA), Polybutadiene (PB), or other thermoplastic or thermoset material, as a list of non-limiting examples. The hardness of the shell material is selected to be within a desired range (e.g., about 25-80 Shore D). The selected material and resulting hardness aids in determining the coefficient of restitution ("C.O.R.").

The shell 14 may define the outer dimensions of the core assembly 12 (in the example of FIGS. 1A, 1B, 1C, 2A, 2B, and 2C, approximately 24 mm in diameter, but the disclosed concepts are not so limited).

FIG. 4 illustrates an exemplary view of a potential layout for a core assembly in accordance with an embodiment herein. In FIG. 4, the core assembly 12 contains a PCB 30, held in place by hexagonal supports 32 as well as an energy storage device 34. The hexagonal supports 32 of the core 12 are configured to interface with one or more surfaces of an inner portion 36A of the shell 28 of the core assembly 12. A material 38 surrounds the inner portion 36A of the core 12. The other side of the core has an outer portion 36B of the core assembly shell 28.

In some examples, the outer portion 36B of the core assembly shell 28 may comprise geometries configured to mate with a hollowed portion 24A and 24B of a hemisphere. In such examples, the geometries configured to mate with a hollowed portion 24A and 24B of a hemisphere may comprise one or more of, for example, grooves, detents, or threadings.

In other examples, the supports 32 of the PCB 30 may comprise different shapes. In some examples, the shape of the supports 32 may be polygonal, including one or more of, for example, triangles, squares, rectangles, parallelograms, hexagons, or octagons.

In another embodiment, the electronic components within the core 12 may be arranged such that they are in direct contact with one or more portions of the inner portion 36A of the core assembly shell 28. In those examples, the inner portion 36A of the core assembly shell 28 may contain geometry configured to interface with geometry on the electronic components within the core 12. The electronic components may further be configured to be removable from the core 12 should replacement of any individual component be needed.

In some examples, the energy storage device 34 may be removably placed within the core assembly 12. In such examples, the energy storage device 34 may be replaced if its charge is depleted, or other components of the core assembly 12 may be serviced in the case of any issue.

The PCB 30 can be formed as a rigid, flex format so that it can be wrapped around a rigid mold (e.g., a PCB hex support structure 32). This structure has a hexagonal shape to allow the PCB 30 to be wrapped around it for ease of manufacturing. There is a space in the center to allow for ease of placement of the energy storage device 34 and aid in the connection of the energy storage device 34 to the PCB 30.

Figure 5:
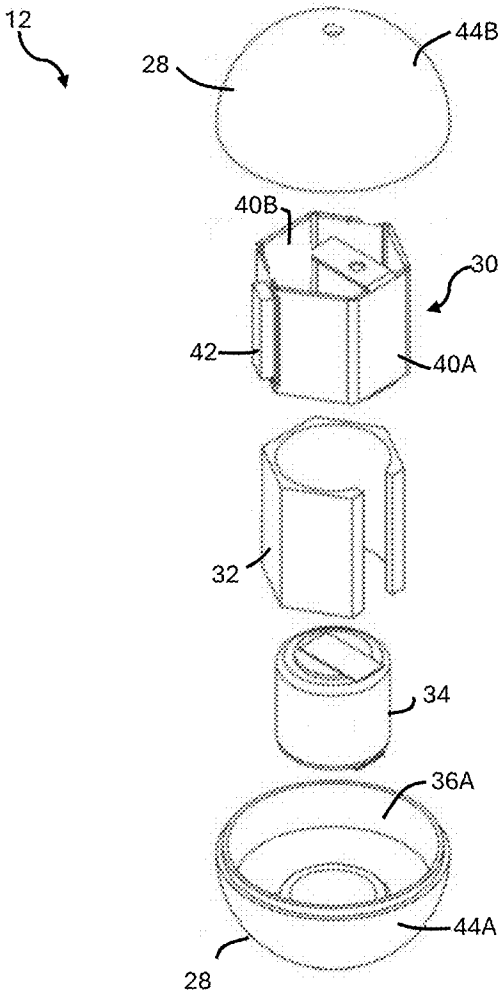
FIG. 5 illustrates perspective views of an exemplary core assembly of an intelligent sports object, in accordance with aspects of this disclosure.

FIG. 5 illustrates an exploded view of a core assembly 12, such as that shown in FIG. 4. As shown, the PCB 30 includes a plurality of sections, panels, or boards 40A and 40B. The PCB 30 is configured to support one or more components 42 (on surface 40A) and is supported by the hexagonal support 32. The components can be selected from one or more of an inertial movement unit, a gyroscope, an accelerometer, a GNSS receiver, a magnetometer, a haptic controller, a temperature sensor, a processor, a memory storage device, a BT low energy baseband controller, UWB baseband controller, a NFC controller, an energy contact, an antenna contact, an antenna, or an induction coil, as a list of non-limiting examples.

This structure also provides a fixed orientation for the PCB 30 and energy storage device 34 (by employing a clocking feature, for example). Arranging the components in a fixed orientation aids with maintaining a known center of mass as well as controlling the direction of components such as antennas, radios, and/or wireless charging, as a list of non-limiting examples.

In some examples, the energy storage device 34 may be a battery. The battery may be rechargeable via induction charging (see FIG. 7), or the battery may be replaceable. In some examples, the battery may be replaceable if the core assembly 12 is removed from the structure.

As shown in FIG. 5, the PCB 30 may include six sections (e.g., 40A and 40B), in which case the mold may be shaped as a hexagon. Thus, the PCB 30 is configured to form a hexagonal cross-section when enveloped around the mold and the energy storage device 34. Although some examples illustrate the PCB 30 as being partitioned into six sections, in some examples the PCB 30 has two, three, four, five, six, seven, eight, nine, ten, or more sections, each section separated by a flexible joint. In some examples, the PCB 30 is a substantially flexible substrate, and can wrap around a cylindrical or prismatic shaped mold. For instance, the PCB 30 can be configured to form a triangular, a square, a hexagonal, an octagonal, or other cross-section when enveloped around the mount and the energy storage device 34. In some examples, the PCB 30 can be constructed to form a polygonal geometry that surrounds the energy storage device 34 on multiple sides. For instance, a generally spherical geometry, such as a truncated icosahedron akin to a soccer ball. Each panel 40 can hold an antenna to form a phased array antenna, resulting in an improved receiver as well as enhanced structural support.

Further, although in some examples the PCB 30 is illustrated as having a length greater than a width or diameter, in some examples the length and width are equal, and in other examples the width is greater than the length. In such examples, the PCB 30 may be configured such that two or more surfaces of the PCB 30 are in direct contact with two or more internal surfaces 36A of the core assembly shell 28.

In some examples, the PCB 30 may be configured to have one or more geometries (e.g., grooves, detents, or threadings) configured to interface with a corresponding geometry on an internal surface 36A of the core assembly shell 28. These geometries may correspond to one or more geometries (e.g., grooves, detents, or threadings) on one or more internal surfaces 36A of the core assembly shell 28. In such examples, the geometries of the PCB 30 are configured to interface with those of the internal surface 36A of the core assembly shell 28 such that the system may be configured to restrict movement of the PCB 30 when it is placed within the core assembly shell 28.

Further, in some examples, the core assembly shell 28 may comprise a geometry (e.g., grooves, detents, or threadings) on its external surface 36B configured to interface with a geometry on an internal surface of a hollowed portion 24A and 24B of the hemispheres 16A and 16B. In such examples, the internal surface of the hemispheres 16A and 16B comprises geometry (e.g., grooves, detents, or threadings) configured to interface with the corresponding geometry of the external surface 36B of the core assembly shell 28.

In another example the PCB 30 may be configured such that two or more surfaces 40A and 40B of the PCB 30 are in direct contact with two or more surfaces of the hollowed portions 24A and 24B of the hemispheres 16A and 16B. The PCB 30 may be further configured to have one or more geometries (e.g., grooves, detents, or threadings) corresponding to one or more geometries on the first and second hemispheres 16A and 16B. In such examples, the PCB 30 is configured to securely mount directly on the first and second hemispheres 16A and 16B of the shell 14. In other examples, an end surface and a lateral surface (e.g., ends of a hexagonal support 32) of the components or PCB 30 may be in direct contact with two or more internal surfaces 36A of the core assembly shell 12.

In other examples, the core 12 includes a mold configured to house the energy storage device 34 in a center of the mold, and to support the plurality of sections of the PCB 30 as the PCB 30 envelops the energy storage device 34.

In other examples the components of the core 12 may be encapsulated by a material. The material may, for example, be a resin or other material. In such examples, the material prohibits movement of the components within the core 12, including the PCB 30 and the energy storage device 34.

In another example, the core assembly shell 28 may be comprised of two hemispheres 44A and 44B. The electronic components of the shell (e.g., PCB 30, energy storage device 34) may be placed within one hemisphere of the core assembly shell 28.

The internal 36A and external 36B surfaces of the core 12 may be treated. For example, the external 36B surface may be subject to various chemical treatments for a variety of purposes. In other examples, the external surface 36B of the core 12 may be textured to be either rough or smooth to better correlate to hollowed portions 24A and 24B of the shell 14.

In some examples, the energy storage device 34 is a rechargeable energy storage device (e.g., a Lithium-ion battery), and the system 10 includes an induction coil configured to receive a wireless signal to generate a current to charge the rechargeable energy storage device 34. The induction coil can be arranged on a surface of the core assembly shell 28 (internal or external) (e.g., FIG. 7). Capacity for the rechargeable energy storage device 34 is selected to allow operational use of the system 10 (e.g., about 15 to 50 mAH). This may allow a golf ball to be used for single or multiple rounds of golf before recharging, for instance.

Figure 6A:
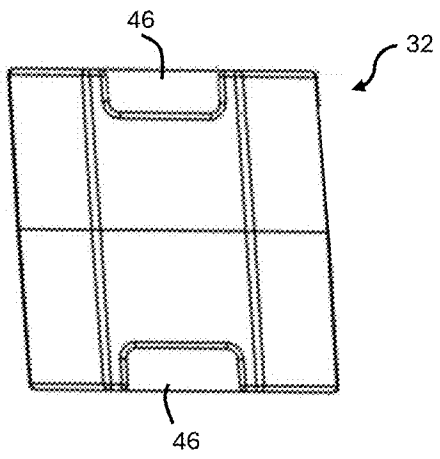
FIGS. 6A and 6B are an exemplary view of hexagonal supports for internal components of an intelligent sports object, and an energy storage device for an intelligent sports object, in accordance with aspects of this disclosure.
Figure 6A:
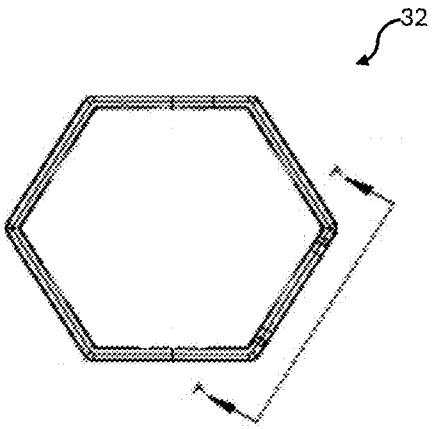
Figure 6B:
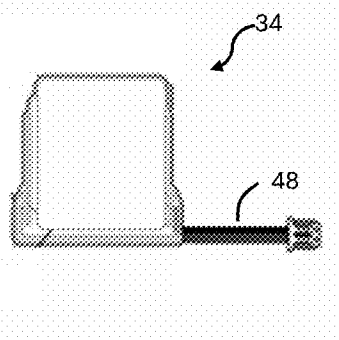

FIGS. 6A and 6B provide example views of a hexagonal support 32 member and energy storage device 34. As depicted in FIG. 6A, in some embodiments, a PCB may be held in place by a hexagonal support 32. In the embodiment depicted in FIG. 6A, the hexagonal support 32 may comprise one piece. In another embodiment, the hexagonal support 32 may be a closed loop. In some embodiments, as shown in FIG. 6A, the hexagonal support 32 may further comprise a notch 46 at the top and/or bottom of a panel of the support 32. The notch 46 may be configured to allow wires 48 from an energy storage device 34, or other electronic device, to connect to components resting on a surface of the hexagonal support 32. Alternatively, the support 32 may not include a notch.

FIG. 6B provides an example view of an energy storage device 34. The energy storage device 34 may comprise a battery. As further shown in FIG. 6B, the energy storage device 34 may contain one or more wires 48 configured to interface with one or more electronic circuitry (e.g., components 42 in FIG. 5 on a surface of a PCB 30). As described herein, in some embodiments, the energy storage device 34 may be configured to be removable from a core (e.g., core 12). In such embodiments, the energy storage device 34 may be configured to be replaced with a new energy storage device 34 as needed in the course of use.

Figure 7:
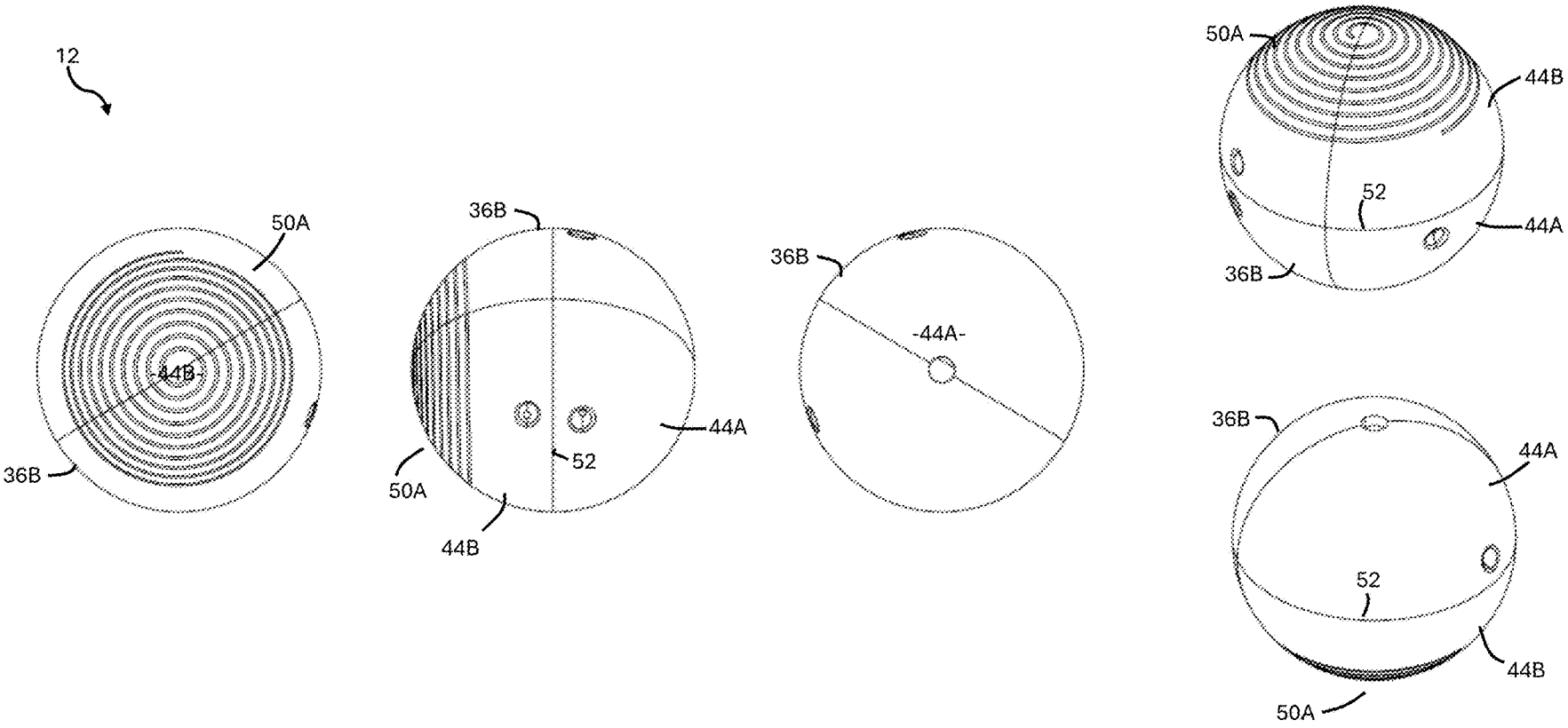
FIG. 7 illustrates an exemplary view of a core of an intelligent sports object, in accordance with another aspect of this disclosure.

FIG. 7 provides an example view of a core assembly with a spiral patterned antenna. As shown, an antenna 50A is arranged in a spiral pattern on an external surface 36B of the core 12, and may be prepared with electrical connections with the PCB 30. This allows communication signals to be shared between components on the PCB 30 and external transceivers. Further, one or more antennas 50A-50D could be employed as an induction coil to receive power to recharge the energy storage device 34.

FIG. 7 further illustrates a configuration, disclosed herein, in which the core 12 comprises a first and second hemisphere 44A, 44B. The hemispheres 44A, 44B mate along a seam 52, which appears on the external surface 36B of the core 12. In some embodiments, the hemispheres 44A, 44B are configured to mate, connect, couple, and/or otherwise be secured to one another, for example, mechanically, chemically, or via other means, along the seam 52.

Wireless charging of the rechargeable energy storage device 34 uses NFC in some examples, with one or more sections of the PCB including components or circuits for charging and/or monitoring the rechargeable energy storage device. For example, the induction coil can be printed or otherwise arranged on a separate section and indexed to ensure alignment with a transmitter coil in a corresponding charger (not shown).

In some examples, the induction coil is arranged in, on or about the core assembly shell 28 away from other antennas. For instance, the system 10 can cause the induction coil, the one or more electrical components, and/or the one or more antennas 50A-50D (FIGS. 8A-8D) to shut-off or become unavailable so as not to impact operation of other components. In some examples, the various transmitters and/or receivers (e.g., GNSS, BT, WiFi, LORA, cellular, etc.) are multiplexed or frequency split to isolate any associated signals if they are operating concurrently.

In some examples, the system employs a gateway at the PCB 30 to selectively connect to power the component(s) being used at a given point during operation. In some examples, induction charging can be limited to a range of frequencies (e.g., from 6.5 MHz to 13.56 MHz) to avoid interfering with or causing damage to other electrical components.

FIGS. 8A, 8B, 8C, and 8D illustrate an alternative arrangement in which an external surface 36B of a core 12 includes a plurality of antennas 50A-50D. In the examples shown in FIGS. 8A, 8B, 8C, and 8D, up to four antennas 50A-50D appear, however, alternative arrangements including more or fewer antennas are possible. The antennas can be separated from each other so as to optimize performance.

In some examples, the plurality of antennas 50A-50D shown in FIGS. 8A, 8B, 8C, and 8D may comprise a variety of types of antennas including, for example, one or more of an ultra wide band antenna, a blue tooth antenna, a global positioning system antenna, or an NFC antenna. In some configurations, the various antennas 50A-50D may be distinct from one another, for example: antenna 50A may be an ultra wide band antenna, while antenna 50B is a blue tooth antenna.

In other examples, one or more of the antennas 50A-50D may be an induction coil, as described with respect to FIG. 7. In such examples, the induction coil may be configured to receive a current to wirelessly charge one or more electrical components within the core 12.

As shown in FIGS. 8A, 8B, 8C, and 8D, a variety of arrangements of the plurality of antennas 50A-50D are possible. Further arrangements for the shapes of the antennas are possible, but not shown. The shapes of the antennas 50A-50D on the external surface 36B of the core 12 yield specific advantages. For example, the type of antenna structure, like spiral, double wound, rectangular spiral using plated through vias, can be used to match the RF performance.

Further, in some embodiments, the antennas 50A-50D are tuned to provide optimum performance. The antennas 50A-50D may comprise one or more of a Monopole, Dipole, and Planar inverted F Antenna. Example lengths for antenna feeds are provided in the following table:

| | Core Comprising Air | Core Filled with Resin or Epoxy |
|---|---|---|
| GPS Monopole Antenna | 4-5.5 centimeters | 2-3.5 centimeters |
| BT Monopole Antenna | 2.5-3.5 centimeters | 1-2.5 centimeters |
| GPS Dipole Antenna | 9-10 centimeters | 5-6 centimeters |
| BT Dipole Antenna | 5.5-7 centimeters | 3-4.5 centimeters |
| GPS Planar inverted F antenna | 9-10 centimeters | 5-6 centimeters |
| BT Planar inverted F antenna | 5.5-7 centimeters | 3-4.5 centimeters |

Figure 9A:
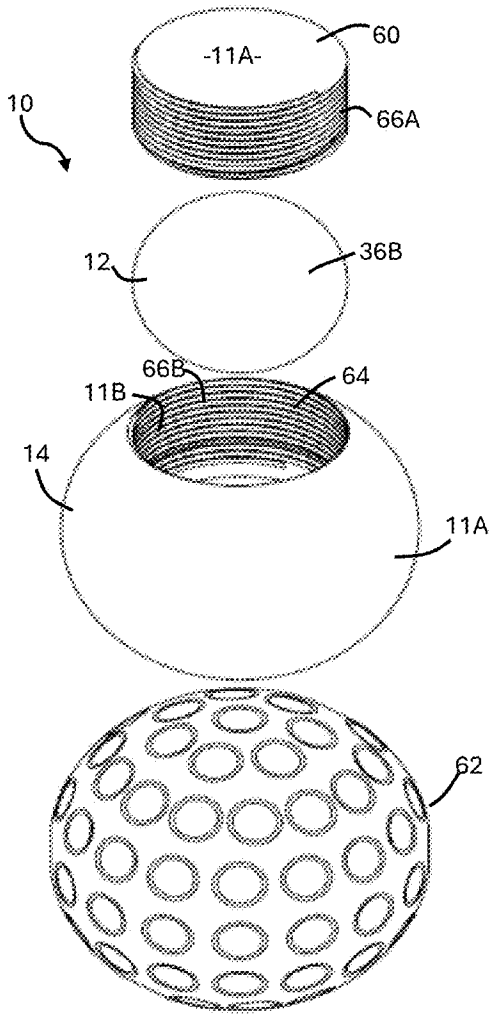
FIGS. 9A, 9B, and 9C illustrate an exemplary intelligent sports object, in accordance with another aspect of this disclosure.
Figure 9B:
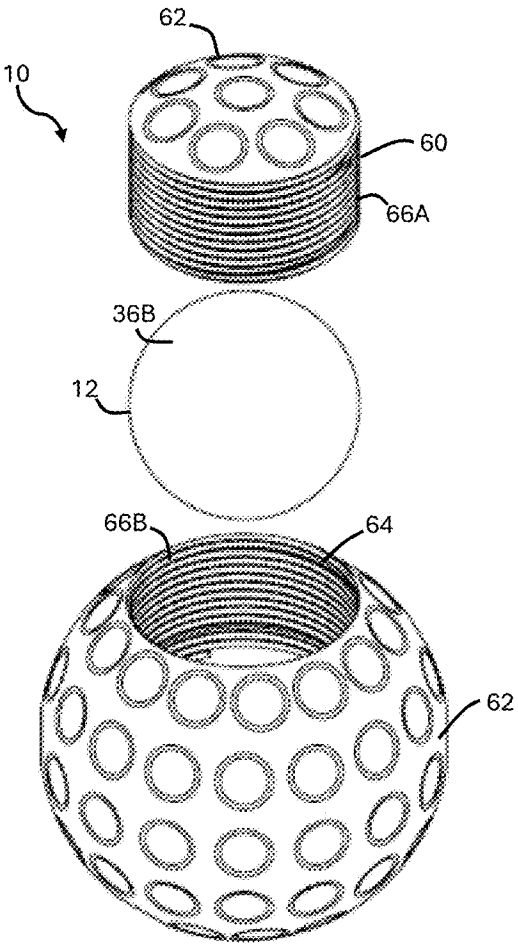
Figure 9C:
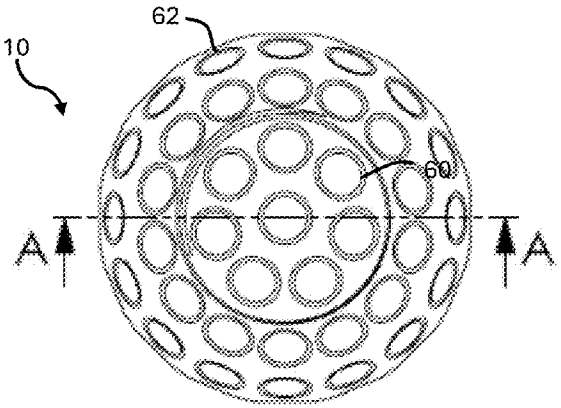
Figure 9C:
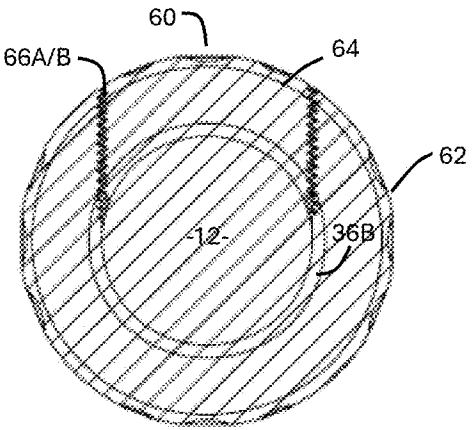

FIGS. 9A, 9B, and 9C illustrate an exemplary system 10 for manufacturing an intelligent sports object. The sports object may be a ball, but is not so limited. As shown in FIGS. 9A and 9B, the system 10 includes a core assembly 12 enclosed within a shell 14 having a plug 60 for an internal cavity 64 of the shell. The plug 60 may be configured to seamlessly interface with the shell 60. The shell 14 can be encapsulated within a material comprising the exterior 62 of the system 10.

The plug 60 for the internal cavity 64 of the shell 14 may seamlessly interface with the external surface 11B of the shell 14, as shown in FIG. 9A. In another example, the plug 60 for the internal cavity 64 may seamlessly interface with an exterior 62 surface of the sports object, as shown in FIGS. 9B and 9C.

In some examples, the plug 60 may contain threading 66A along its sides. In such examples, the internal cavity 64 of the shell 14 may also contain threading 66B. In these examples (as shown in FIGS. 9A-9C), the plug 60 and the internal cavity 64 of the shell 14 are threadably engaged such that the plug 60 may be removed from the internal cavity 64. In other examples, the core assembly 12, may be threadably engaged with the internal cavity 64 such that the core assembly 12 may be removed.

In some examples, the energy storage device 34 may be removably placed within the core assembly 12. In such examples, the plug 60 may be removed from the internal cavity 64 of the shell 14 via threading (e.g., 66A and 66B) or other means in order to remove and replace the energy storage device 34 as needed. In some examples, the energy storage device 34 may contain threading such that it is threadably engaged with the core assembly 12.

The core 12 may be the same or substantially the same as the core 12 described herein. For example, the core 12 may comprise geometries on an external surface of its shell 36B configured to interface with geometries on an inner surface of the cavity 64. In such examples, the geometries may comprise one or more of grooves, detents, or additional threadings. The geometries of the core 12 and inner surface of the cavity 64 may be configured to restrict movement of the core within the sporting object when the plug 60 is placed over the cavity 64.

Once the core assembly 12 is completed, the shell and the components may be potted/encapsulated (e.g., with one or more of a resin, epoxy, silicones, polyurethanes, etc.). The encapsulant holds the core assembly 12 together as a solid unit while protecting the electronics and battery inside. A plugged hole may nonetheless be cut in the solid unit, enabling removal of the core assembly 12, while leaving components inside the shell 14 in place. In some examples, the durometer of the encapsulant compound will be in the range of 35-95A depending on the desired C.O.R.

In lieu of the shell 14, the electronics and support can be overmolded using low-pressure molding to contain all the components. In some examples, this can replace the shell and encapsulant, whereas in other examples it is provided in addition to the shell 14.

In some examples, the core 12 may further comprise a port. The port may be configured such that it may interface with an external cord. The port may be configured to receive an external cord. In some examples, the core 12 may be configured such that the port is accessible when the plug 60 is removed from the sporting object. The external cord may, for example, be configured to charge one or more components of the core 12, including, for example, the energy storage device 34. The port may be configured to receive one of a USB-A cord, a USB-C cord, or another electronic cord.

Figure 10A:
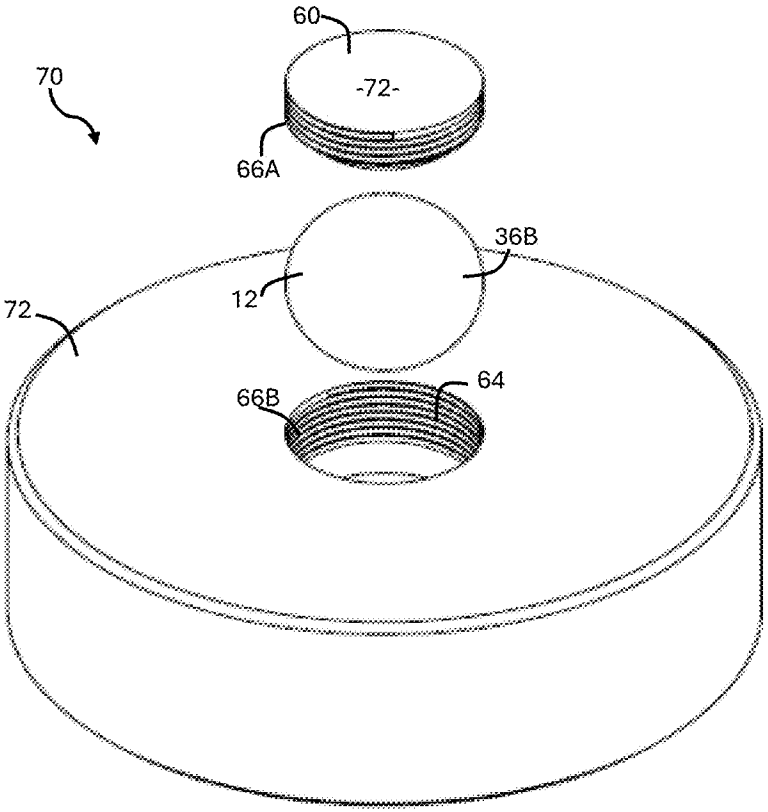
FIGS. 10A and 10B are an exemplary view of an alternative intelligent sports object, in accordance with aspects of this disclosure.
Figure 10B:
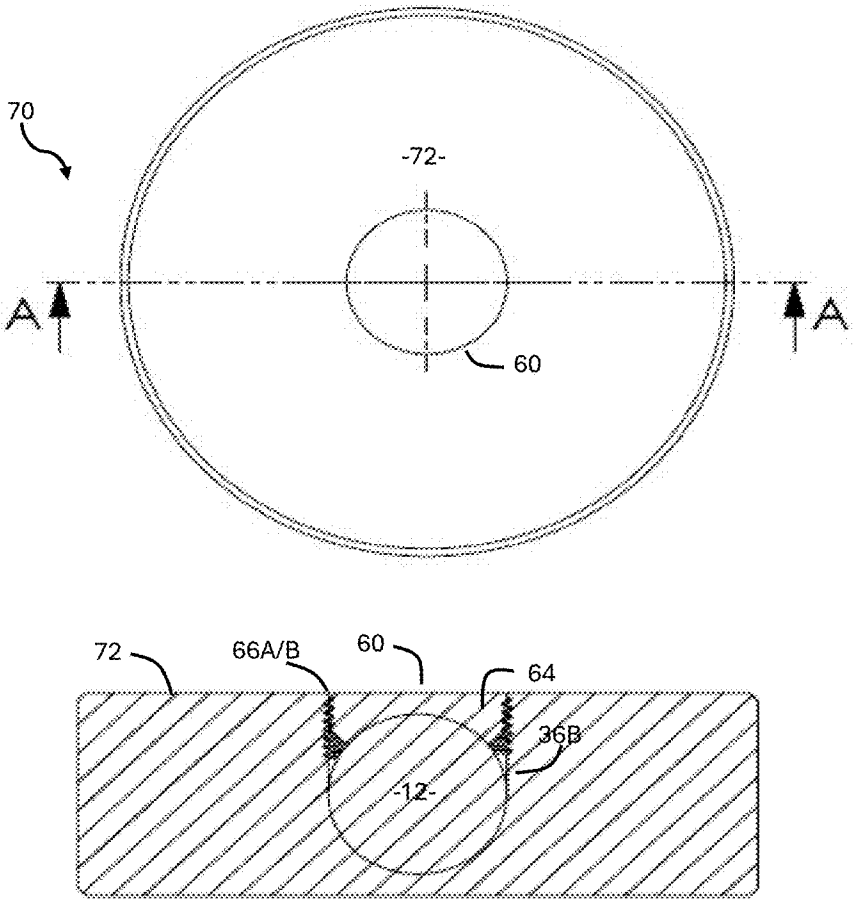

FIGS. 10A and 10B provide an exemplary view of the sports object 70 comprising a plug described with respect to FIGS. 9A, 9B, and 9C. The sports object 70 of FIGS. 10A and 10B is not spherical, and is instead cylindrical, such as, for example, an ice hockey puck. The plug 60 may be configured to reside flush with a surface of the sports object 70, as shown in FIGS. 9B and 9C. The core assembly 12 may be removably placed within a shell 14. In FIGS. 10A and 10B, the core assembly 12 is placed directly within the sports object 70, such as the configuration shown in FIGS. 9B and 9C.

As shown in FIGS. 10A and 10B, the sports object 70 may comprise a plug 60 which is threadably engaged to a cavity 64. In such examples, the cavity 64 and the plug 60 each may comprise threading 66A and 66B. The threading 66A and 66B may be configured such that when the plug 60 and the cavity 64 are mated, the plug 60 rests flush with a surface 72 of the sporting object 70, as shown in FIG. 10B. In some examples, the surface of the plug 60 may be a portion of the surface 72 of the sporting object 70.

In other examples, the plug 60 and the cavity 64 may be engaged via means other than threading. For example, the plug 60 may be configured to reside flush with a surface 72 of the sporting object 70. In another example, the plug 60 may interface with the cavity 64 via other means, including, for example, via one or more grooves or detents. In other examples, the plug 60 may be secured to the cavity 64 via chemical means (e.g., adhesives).

With continued reference to FIGS. 10A and 10B, the core 12 of the sporting object 70 may be the same or similar to the core 12 described with respect to other embodiments herein. For example, the core 12 may comprise geometries on an external surface 36B of its shell configured to interface with geometries on an inner surface of the cavity 64 (e.g., grooves, detents, or additional threadings). The geometries may be configured to restrict movement of the core 12 once the plug 60 is placed over the cavity 64.

Figure 11:
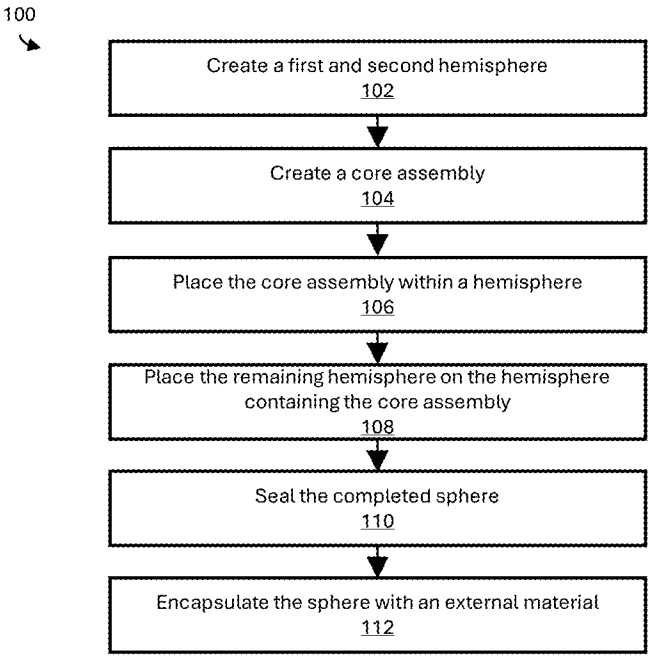
FIG. 11 is an example method for producing an intelligent sports object, in accordance with aspects of this disclosure.

Turning to FIG. 11, an example method 100 is provided for manufacturing an intelligent sports object (e.g., a sporting object 70 or system 10). FIG. 11 provides an example method for manufacturing an intelligent sports object, including two hemispheres with hollowed portions configured to contain a core assembly. The method may be utilized to create an intelligent sporting object, such as the one shown in FIGS. 1 through 4.

As shown in block 102 of FIG. 11, a first and second hemisphere (e.g., hemispheres 16A and 16B), are created. For example, the hemispheres may be created with hollowed portions (as described with respect to FIGS. 1A, 1B, and 1C). In such examples, the hollowed portions may further comprise geometry (e.g., grooves, detents, or threading) to securely accommodate a core assembly.

The structure shown in FIGS. 2A-2C may be created via a molding process, in accordance with a disclosure herein. A mold may be created for each hemisphere, allowing the hemispheres to be created with the geometries (e.g., geometries 26A and 26B) to efficiently manufacture intelligent sporting objects. In another example, the core assembly shell 28 comprises two hemispheres, which may also be created via a molding process. Molds for either structure may be comprised of any number of acceptable molding materials, including, for example, medium density fiberboard, polyvinyl chloride, polyurethane, or any other acceptable molding material.

As shown in block 104 of FIG. 11, a core assembly (e.g., core 12) is created. The core assembly may comprise or may be comparable to that described in U.S. patent application Ser. No. 15/863,795, but is not so limited. In some examples, the core assembly may further comprise geometry (e.g., grooves, detents, or threading) to securely interface with hollowed portions of a first and second hemisphere.

As shown in block 106 of FIG. 11, the core assembly (e.g., core 12) is placed within one of the two hemispheres (e.g., hemispheres 16A and 16B) created in block 102. For instance, in one embodiment, grooves, detents, or threading of the hemisphere may interface with corresponding geometry (e.g., grooves, detents, or threading) of the core assembly. In this example, the core assembly may be configured such that it resides securely in the hollowed portion of the hemisphere.

Once the core has been placed in one hemisphere, the other hemisphere is placed on the hemisphere containing the core assembly, as shown in block 108 of FIG. 11. The two hemispheres may be configured to create a complete sphere, with a seamless interface between the two hemispheres.

In some embodiments, the second hemisphere may be placed such that geometry (e.g., grooves, detents, or threading) of the second hemisphere interface with corresponding geometry of the core assembly. In such examples, the geometry of the core assembly and hemispheres may be configured such that the core assembly cannot move once the two hemispheres form a completed sphere.

In other examples, the means for securing the two hemispheres (e.g., 16A and 16B via holes, detents, etc. (e.g., geometry holes 22 and pins 20 or geometries 26A and 26B)) may be created via a molding process as described above. Molds may be created for each hemisphere including means for securing the hemispheres to one another.

Once the core assembly has been placed between the two hemispheres (block 108) the completed sphere is sealed, as shown in block 110 of FIG. 11, for example, using adhesive material. The adhesive material may, for example, be a urethan adhesive, such as 3M DP601. In some examples, the adhesive material may be configured such that its bond can be broken at a later time, allowing access to the core. The hemispheres can be snap fit, a threaded feature, an adhesive/epoxy bonded joint, and thermal welded (such as laser, ultrasonic, or hot plate welding), as a list of non-limiting examples.

In block 112, the sealed sphere may be encapsulated with an external material (e.g., exterior 62 material). The external material may comprise one or more materials and may form a protective outer layer for the sphere. In some embodiments, the external material may comprise "dimples" as in a golf ball, but the disclosed technology is not so limited. The external material may comprise any number of materials and may serve to protect the seal of the hemispheres from stress applied to the sporting object in regular use.

The term "sports object" includes any object that is used in various sports-related activities, such as golf balls, soccer balls, basketballs, baseballs, footballs, tennis balls, lacrosse ball, cricket ball, hockey pucks, and flying discs, as a list of non-limiting examples. Thus, while examples of the system 10 and associated methods are discussed in the context of golf for illustrative purposes, the disclosed concepts are not so limited. Rather, the system 10 and associated methods may be incorporated into any other type of sports objects now known or later developed.

Methods and processes of collecting information are provided in U.S. patent application Ser. Nos. 15/863,795 and 19/169,523, entitled "Real-Time Tracking System for Sports Scoring Objects and Methods of Use" and "Communications and Power Hub for a Sporting Object," respectively, which are herein incorporated by reference in their entirety.

A system for real-time tracking a sports objects and associated methods of use are disclosed and configured for monitoring and tracking various attributes associated with the movement of sports objects. Because the principles of the disclosed subject matter may be practiced in a number of configurations and/or applications beyond those shown and described, it is to be understood that the disclosure is not in any way limited by the provided examples, but is generally directed to a real-time tracking system for sports objects and is able to take numerous forms to do so without departing from the spirit and scope of the disclosed examples. One skilled in the art would appreciate the disclosed subject matter is not limited to the particular geometries and materials of construction disclosed, but may instead entail other functionally comparable structures or materials, now known or later developed, without departing from the spirit and scope of this disclosure.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the disclosure are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an example or aspect of an example also carries with it the alternative meaning of "may not" or "cannot." As such, if the present specification discloses that an example or an aspect of an example may be or can be included as part of the inventive subject matter, then the negative limitation or exclusionary proviso is also explicitly meant, meaning that an example or an aspect of an example may not be or cannot be included as part of the inventive subject matter. In a similar manner, use of the term "optionally" in reference to an example or aspect of an example means that such example or aspect of the example may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present disclosure (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present disclosure and does not pose a limitation on the scope of the disclosure otherwise claimed. No language in the present specification should be construed as indicating any non-claimed element essential to the practice of the disclosure.

When used in the claims, whether as filed or added per amendment, the open-ended transitional term "comprising" (along with equivalent open-ended transitional phrases thereof such as "including," "containing" and "having") encompasses all the expressly recited elements, limitations, steps and/or features alone or in combination with un-recited subject matter; the named elements, limitations and/or features are essential, but other unnamed elements, limitations and/or features may be added and still form a construct within the scope of the claim. Specific examples disclosed herein may be further limited in the claims using the closed-ended transitional phrases "consisting of" or "consisting essentially of" in lieu of or as an amendment for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones.

The meaning of the closed-ended transitional phrase "consisting of" is being defined as only including those elements, limitations, steps and/or features specifically recited in the claim, whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (along with equivalent open-ended transitional phrases thereof) includes within its meaning, as a limiting case, claimed subject matter specified by the closed-ended transitional phrases "consisting of" or "consisting essentially of." As such, examples described herein or so claimed with the phrase "comprising" are expressly or inherently unambiguously described, enabled and supported herein for the phrases "consisting essentially of" and "consisting of."

All patents, patent publications, and other publications referenced and identified in the present specification are individually and expressly incorporated herein by reference in their entirety for the purpose of describing and disclosing, for example, the compositions and methodologies described in such publications that might be used in connection with the present disclosure. These publications are provided solely for their disclosure prior to the filing date of the present application. Nothing in this regard should be construed as an admission that the inventors are not entitled to antedate such disclosure by virtue of prior disclosure or for any other reason. All statements as to the date or representation as to the contents of these documents are based on the information available to the applicants and does not constitute any admission as to the correctness of the dates or contents of these documents.

It should be understood that the logic code, programs, modules, processes, methods, and the order in which the respective elements of each method are performed are purely exemplary. Depending on the implementation, they may be performed in any order or in parallel, unless indicated otherwise in the present disclosure. Further, the logic code is not related, or limited to any particular programming language, and may comprise one or more modules that execute on one or more processors in a distributed, non-distributed, or multiprocessing environment.

The methods described above may be used in the fabrication of integrated circuit chips. The resulting integrated circuit chips can be distributed by the fabricator in raw wafer form (that is, as a single wafer that has multiple unpackaged chips), as a bare die, or in a packaged form. In the latter case, the chip is mounted in a single chip package (such as a plastic carrier, with leads that are affixed to a motherboard or other higher level carrier) or in a multi-chip package (such as a ceramic carrier that has either or both surface interconnections or buried interconnections). In any case, the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

While aspects of the disclosure have been described with reference to at least one exemplary example, it is to be clearly understood by those skilled in the art that the disclosure is not limited thereto. Rather, the scope of the disclosure is to be interpreted only in conjunction with the appended claims, and it is made clear, here, that the inventor(s) believes that the claimed subject matter is the disclosure.

What is claimed is:

1. An intelligent sports object comprising:

a core assembly removably placed within a shell, wherein the shell comprises:

a first hemisphere containing a hollowed portion; and a second hemisphere containing a hollowed portion, and wherein the first hemisphere is configured to interface with the second hemisphere, the first and second hemispheres forming a complete sphere, wherein the core assembly comprises:

a core assembly shell;

an energy storage device arranged within the shell; and one or more electronic components arranged within and in direct contact with the core assembly shell, such that an end surface and a lateral surface of the components are in direct contact with two or more internal surfaces of the core assembly shell, and wherein the core assembly is configured to fit within the hollowed portions of the complete sphere when the first and second hemisphere are interfaced.

2. The sports object of claim 1, wherein the core assembly shell has an external geometry configured to mate with an internal geometry of the hollowed portions.

3. The sports object of claim 2, wherein the external and internal geometries comprise one or more grooves configured to secure the core assembly within the shell.

4. The sports object of claim 2, wherein the external and internal geometries comprise one or more detents configured to secure the core assembly within the shell.

5. The sports object of claim 2, wherein the external and internal geometries are configured to form a polygonal, cross-section in a variety of shapes, wherein the shapes include one or more of a triangle, a square, a hexagon, or an octagon.

6. The sports object of claim 1, wherein the energy storage device is removably placed within the core assembly.

7. The sports object of claim 6, wherein the energy storage device is configured to be replaced with another energy storage device.

8. The sports object of claim 1, wherein the core assembly is configured to be replaced with another core assembly.

9. The sports object of claim 1, wherein the first and second hemispheres are configured to be separable.

10. The sports object of claim 1, wherein the first and second hemispheres are created using a mold configured to create a hemisphere.

11. The sports object of claim 1, wherein the electronic components comprise:

a multi-layer printed circuit board (PCB) comprised of one or more contacts and a plurality of sections, the PCB configured to at least partially envelope the energy storage device; and one or more antennas arranged within the shell, wherein the one or more contacts of the PCB are configured to connect to the one or more antennas.

12. The sports object of claim 1, wherein the energy storage device is arranged within the core assembly shell.

13. An intelligent sports object comprising:

a core assembly enclosed within a shell, wherein the shell has an internal cavity, wherein the internal cavity is configured to receive the core assembly and to form a polygonal cross-section in a variety of shapes, wherein the shapes include one or more of a triangle, a square, a hexagon, or an octagon, and wherein the core assembly comprises:

an energy storage device, wherein the energy storage device is removably placed within the core assembly; and one or more electronic components arranged within the shell; and a plug for the internal cavity of the shell, wherein the plug is configured to seamlessly interface with the shell.

14. The sports object of claim 13, wherein the one or more electronic components include a multi-layer printed circuit board (PCB) surrounding a support which partially surrounds the energy storage device.

15. The sports object of claim 14, wherein a resin surrounds the electronic components.

16. The sports object of claim 14, further comprising one or more antennas arranged within the shell, wherein one or more contacts of the PCB are configured to connect to the one or more antennas.

17. The sports object of claim 13, wherein the core assembly further comprises a port, wherein the port is configured to receive a charging cable configured to charge the energy storage device.

18. The sports object of claim 13, wherein the plug is fixed to the core assembly.

19. The sports object of claim 13, wherein the energy storage device is threadably engaged with the core assembly.

20. The sports object of claim 13, wherein the core assembly is threadably engaged with the cavity.

21. A process of manufacturing an intelligent sporting object, the process comprising the steps of:

creating a first and second hemisphere, the first and second hemispheres each containing a hollowed portion;

the first hemisphere containing holes, and the second hemisphere containing posts;

creating a core assembly, the core assembly comprising one or more electronic components and an energy storage device;

placing the core assembly within the hollowed portion of either the first or second hemisphere;

securing the holes of the first hemisphere to the posts of the second hemisphere;

placing the remaining hemisphere on the hemisphere containing the core assembly;

sealing the completed sphere structure; and encapsulating the sphere with an external material.

* * * * *